US007810472B2

(12) United States Patent
Kondo et al.

(10) Patent No.: US 7,810,472 B2
(45) Date of Patent: Oct. 12, 2010

(54) FUEL PRESSURE SENSOR/SENSOR MOUNT ASSEMBLY

(75) Inventors: Jun Kondo, Nagoya (JP); Tomoki Fujino, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/409,953

(22) Filed: Mar. 24, 2009

(65) Prior Publication Data

US 2009/0241907 A1 Oct. 1, 2009

(30) Foreign Application Priority Data

Mar. 28, 2008 (JP) ..... 2008-086991

(51) Int. Cl.
*F02M 69/46* (2006.01)
*F02M 55/02* (2006.01)

(52) U.S. Cl. ..... 123/456; 123/468; 123/494; 73/114.43

(58) Field of Classification Search ..... 123/456, 123/468, 469, 470, 494; 73/114.31, 114.43, 73/114.51
See application file for complete search history.

(56) References Cited

U.S. PATENT DOCUMENTS

| | | | | |
|---|---|---|---|---|
| 6,494,186 | B1 * | 12/2002 | Wakeman | 123/479 |
| 6,802,539 | B2 * | 10/2004 | Cooke et al. | 285/124.1 |
| 7,004,146 | B1 | 2/2006 | Kato | |
| 2004/0007212 | A1 | 1/2004 | Kato | |
| 2008/0184962 | A1 | 8/2008 | Pauer | |
| 2009/0241650 | A1 * | 10/2009 | Kondo et al. | 73/114.43 |
| 2009/0248276 | A1 * | 10/2009 | Kondo et al. | 701/103 |
| 2010/0050991 | A1 * | 3/2010 | Cooke | 123/470 |
| 2010/0096480 | A1 * | 4/2010 | Kondo et al. | 239/584 |

FOREIGN PATENT DOCUMENTS

| | | |
|---|---|---|
| DE | 10 2005 012 928 | 9/2006 |
| DE | 10 2005 024 194 | 11/2006 |
| EP | 1 925 803 | 5/2008 |
| JP | 2000-265892 | 9/2000 |
| JP | 2008-144749 | 6/2008 |

OTHER PUBLICATIONS

Extended European Search Report dated Jun. 4, 2010, issued in corresponding European Application No. 09156424.5-1263.

* cited by examiner

*Primary Examiner*—Thomas N Moulis
(74) *Attorney, Agent, or Firm*—Nixon & Vanderhye PC

(57) ABSTRACT

A fuel pressure sensor/sensor mount assembly for use in a fuel injection system equipped with fuel injectors which inject fuel, as supplied from an accumulator through fuel pipes, into a multi-cylinder internal combustion engine mounted in an engine compartment of a vehicle. The assembly includes a connector unit and fuel pressure sensors. The connector unit has formed therein a plurality of communication paths each of which is to establish a connection between one of the fuel injectors and the accumulator through one of the fuel pipes. The connector unit also has formed therein sensor mounts exposed to the communication paths. Each of the fuel pressure sensors is disposed in the sensor mount to measure the pressure of the fuel in the communication path. This structure permits steps of installing the fuel pressure sensors within the engine compartment to be decreased and ensures desired measurement accuracy of the fuel pressure sensors.

10 Claims, 7 Drawing Sheets

FUEL PRESSURE SENSOR/SENSOR MOUNT ASSEMBLY

CROSS REFERENCE TO RELATED DOCUMENT

The present application claims the benefit of Japanese Patent Application No. 2008-86991 filed on Mar. 28, 2008, the disclosures of which are incorporated herein by reference.

BACKGROUND OF THE INVENTION

1. Technical Field of the Invention

The present invention relates generally to a fuel pressure sensor/sensor mount assembly in which a fuel pressure sensor is so mounted as to exposed to a high-pressure fuel path through which fuel is supplied to a fuel injector.

2. Background Art

In order to ensure the accuracy in controlling output torque of internal combustion engines and the quantity of exhaust emissions therefrom, it is essential to control a fuel injection mode such as the quantity of fuel to be sprayed from a fuel injector or the injection timing at which the fuel injector starts to spray the fuel. For controlling such a fuel injection mode, there have been proposed techniques for monitoring a change in pressure of the fuel upon spraying thereof from the fuel injector.

Specifically, the time when the pressure of the fuel begins to drop due to the spraying thereof from the fuel injector may be used to determine an actual injection timing at which the fuel has been sprayed actually. The amount of drop in pressure of the fuel arising from the spraying thereof may be used to determine the quantity of fuel sprayed actually from the fuel injector. Such actual observation of the fuel injection mode ensures the desired accuracy in controlling the fuel injection mode.

For instance, in the case where a change in pressure of the fuel arising from the spraying of the fuel from the fuel injector (which will also be referred to as a fuel pressure change below) is measured using a fuel pressure sensor installed directly in a common rail (i.e., a fuel accumulator), it will be somewhat absorbed within the common rail, thus resulting in a decrease in accuracy in determining such a pressure change. In order to alleviate this drawback, Japanese Patent First Publication No. 2000-265892 teaches installation of the fuel pressure sensor in a joint between the common rail and a high-pressure pipe through which the fuel is delivered from the common rail to the fuel injector to measure the fuel pressure change before it is absorbed within the common rail.

In the case of automotive vehicles in which an internal combustion engine is mounted in an engine compartment, it is necessary to install various types of parts such as fuel injectors and a common rail in a small working space within the engine compartment. The workability in such an engine compartment is usually bad. It is, thus, preferable to minimize parts to be installed on or in the engine of the vehicles.

The structure, as disclosed in the above publication, requires the installation of a plurality of fuel pressure sensors in the engine, thus resulting in increased installation processes within the engine compartment.

SUMMARY OF THE INVENTION

It is therefore a principal object of the invention to avoid the disadvantages of the prior art.

It is another object of the invention to provide a fuel pressure sensor/sensor mount assembly in which a fuel pressure sensor is so mounted as to exposed to a high-pressure fuel path through which fuel is supplied to a fuel injector and which is designed to minimize steps of installing parts within the engine compartment.

According to one aspect of the present invention, there is provided a fuel pressure sensor/sensor mount assembly for use in a fuel injection system equipped with fuel injectors which inject fuel, as supplied from an accumulator through fuel pipes, into a multi-cylinder internal combustion engine mounted in an engine compartment of a vehicle. The fuel pressure sensor/sensor mount assembly comprises: (a) a connector unit having formed therein a plurality of communication paths each of which is to establish a connection between one of the fuel injectors and the accumulator through one of the fuel pipes, the connector unit also having formed therein sensor mounts exposed to the communication paths, respectively; and (g) fuel pressure sensors mounted one in each of the sensor mounts of the connector unit. Each of the fuel pressure sensors is sensitive to a pressure of the fuel in a corresponding one of the communication paths to produce a signal indicative thereof.

Specifically, each of the fuel pressure sensors works to measure the pressure of the fuel flowing to the fuel injector through the communication path leading from the accumulator, thereby resulting in increased accuracy in determining a change in pressure of the fuel arising from spraying of the fuel from the fuel injector as compared with when a fuel pressure sensor is installed to the accumulator. The communication paths which establish fluid communications between the fuel injectors and the fuel pipes are formed in the connector unit. The fuel pressure sensors are installed in the connector unit so as to be exposed to the communication paths. Specifically, the fuel pressure sensors and the connector unit are prepared as the fuel pressure sensor/sensor mount assembly before being joined to the fuel injectors, thus facilitating the ease of installation of the fuel pressure sensors and joining of the fuel injectors to the accumulator within the engine compartment.

In the preferred mode of the invention, the connector unit is disposed between the fuel injectors and the fuel pipes. We have analyzed three sensor mounting locations between the accumulator and the fuel pipes, in the fuel pipes, and between the fuel pipes and the fuel injectors and found experimentally that it is preferable to place the fuel pressure sensors between the fuel pipes and the fuel injectors because it is closest to spray holes of the fuel injectors. Such a location, however, requires hard work to install the fuel pressure sensors in a small space within the engine compartment. The use of the fuel pressure sensor/sensor mount assembly alleviate such a drawback.

The communication paths may be formed in the connector unit, one for each of all of cylinders of the internal combustion engine.

The connector unit may be designed to have a joint serving to establish a mechanical joint of the connector unit to a cylinder head of the internal combustion engine, so that the connector unit functions as a clamp to clamp the fuel injectors to the cylinder head.

The fuel pressure sensor/sensor mount assembly may further comprises a second connector unit identical in structure as the connector unit. Each of the connector unit and the second connector unit has a joint serving to establish a mechanical joint to a cylinder head of the internal combustion engine, so that each of the connector unit and the connector unit functions as a clamp to clamp the fuel injectors to the cylinder head.

The connector unit may have formed therein a common wire distribution path through which conductive wires of the fuel pressure sensors extend.

The connector unit may have a common connector to which conductive wires of the fuel pressure sensors are joined.

The connector unit may be equipped with a cooling mechanism working to cool the fuel pressure sensors.

The cooling mechanism includes a coolant path formed in the connector unit through which coolant flows to cool the fuel pressure sensors.

According to another aspect of the invention, there is provided a fuel pressure sensor/sensor mount assembly for use in a fuel injection system equipped with fuel injectors which inject fuel, as supplied from an accumulator through fuel pipes, into a multi-cylinder internal combustion engine mounted in an engine compartment of a vehicle. The fuel pressure sensor/sensor mount assembly comprises: (a) clamps working to clamp the fuel injector to a cylinder head of the internal combustion engine, the clamp having formed therein a plurality of communication paths each of which is to establish a connection between one of the fuel injectors and the accumulator through one of the fuel pipes, the clamps also having formed therein sensor mounts exposed to the communication paths, respectively; and (b) fuel pressure sensors mounted one in each of the sensor mounts of the clamps. Each of the fuel pressure sensors is sensitive to a pressure of the fuel in a corresponding one of the communication paths to produce a signal indicative thereof.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4(*b*) is a cross section which shows a connector unit according to the second embodiment of the invention;

DESCRIPTION OF THE PREFERRED EMBODIMENTS

Figure 1:
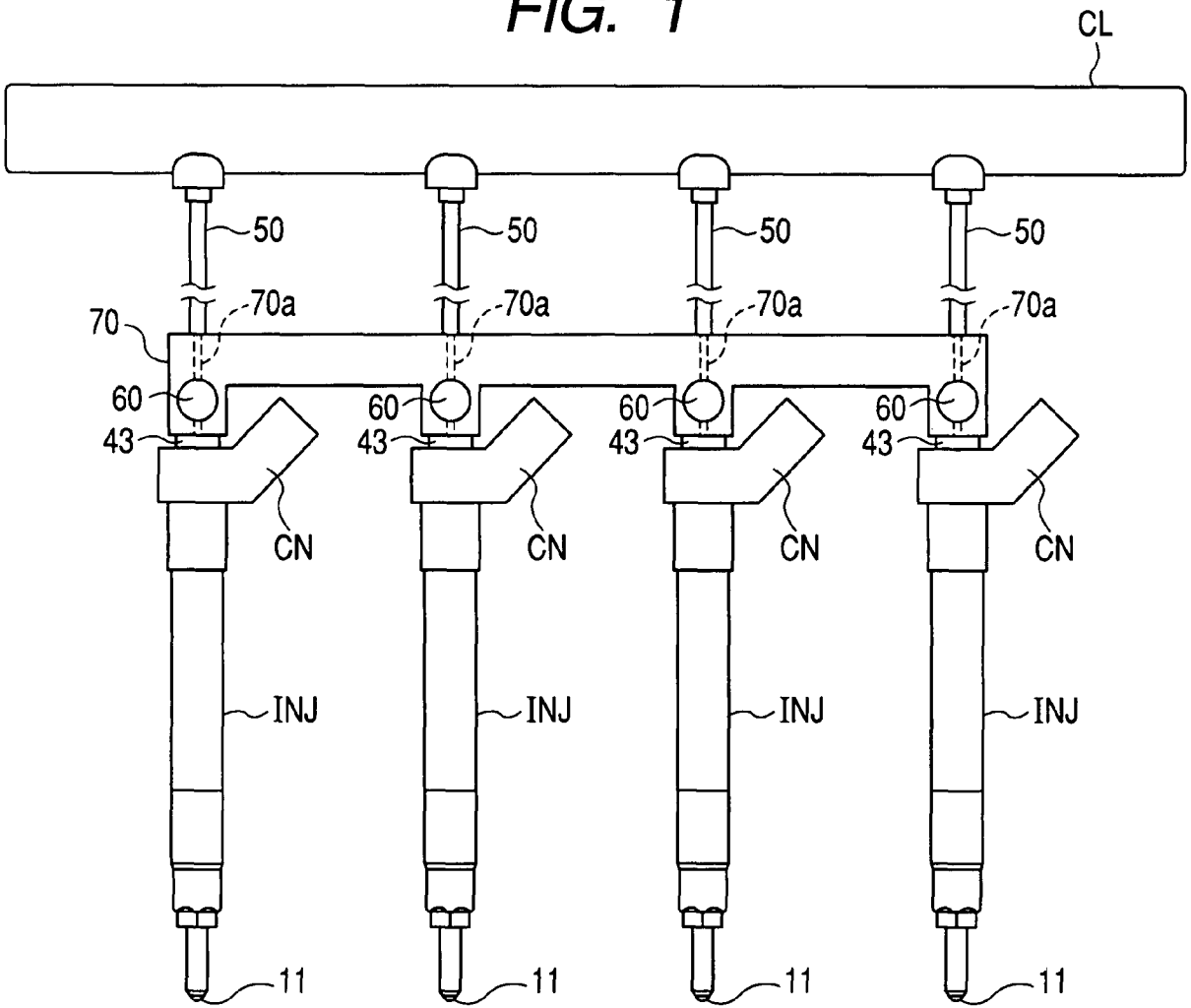
FIG. 1 is a schematic view which shows fuel injectors joined to a common rail through a connector unit according to the first embodiment of the invention.
Figure 2:
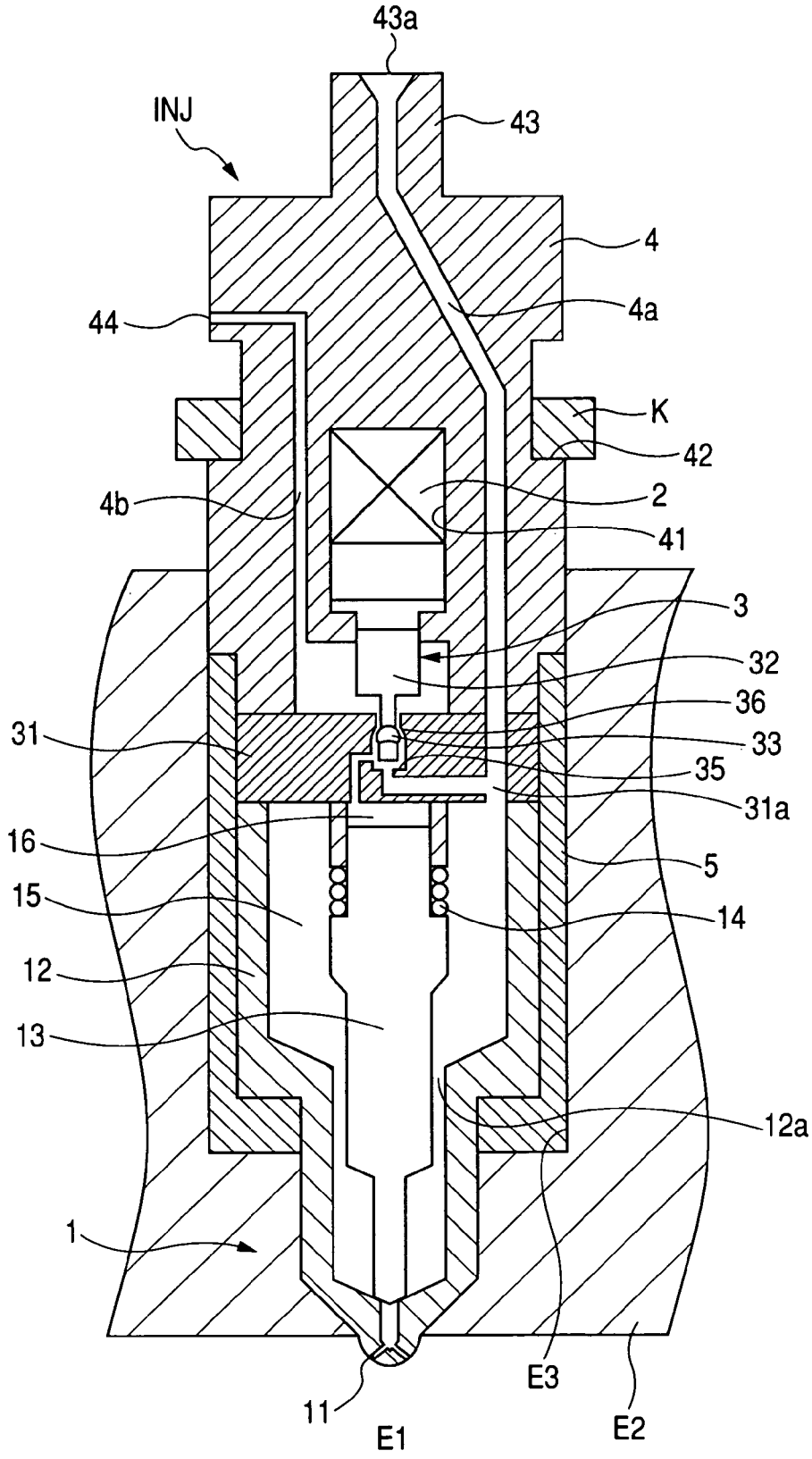
FIG. 2 is a longitudinal sectional view which shows an internal structure of each of the fuel injectors of FIG. 1.
Figure 3:
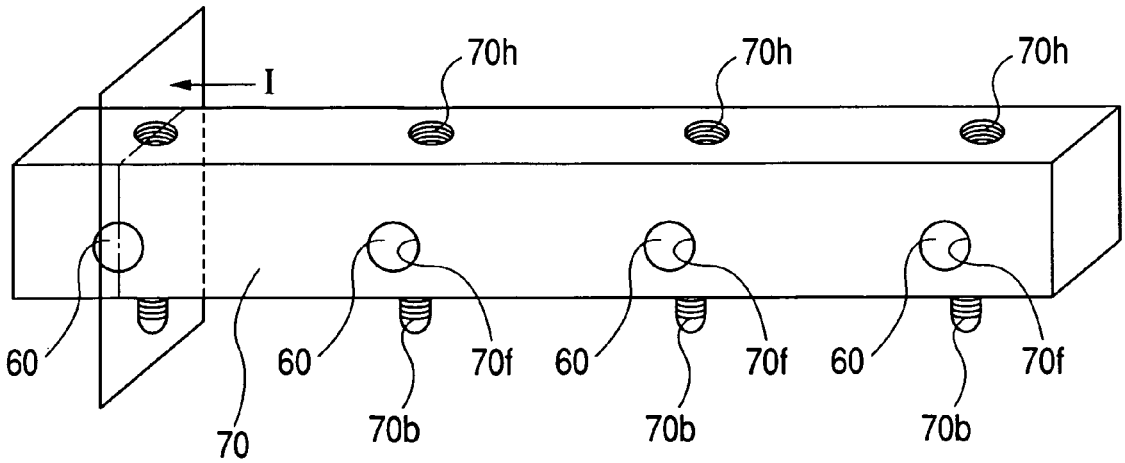
FIG. 3 is a perspective view which shows the connector unit of FIG. 1 in which fuel pressure sensors are mounted and which establishes mechanical joints between the fuel injectors and the common rail.
Figure 4A:
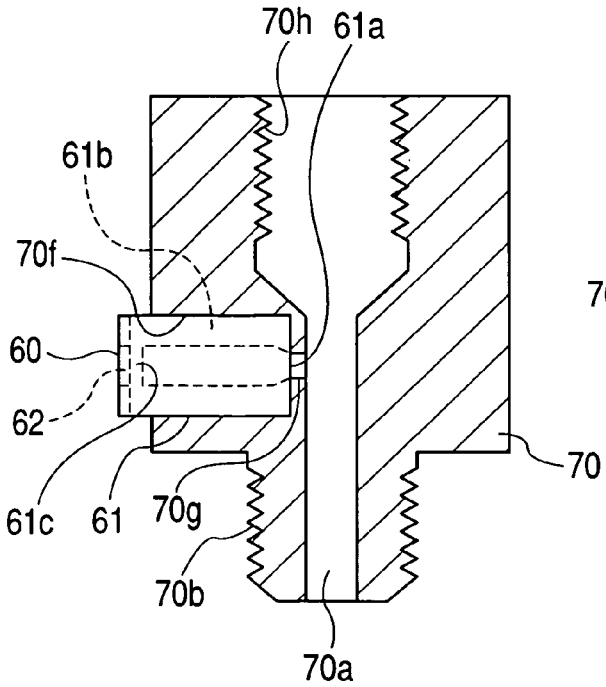
FIG. 4(*a*) is a cross section, as represented by a dashed line in FIG. 3, of the connector unit.
Figure 4B:
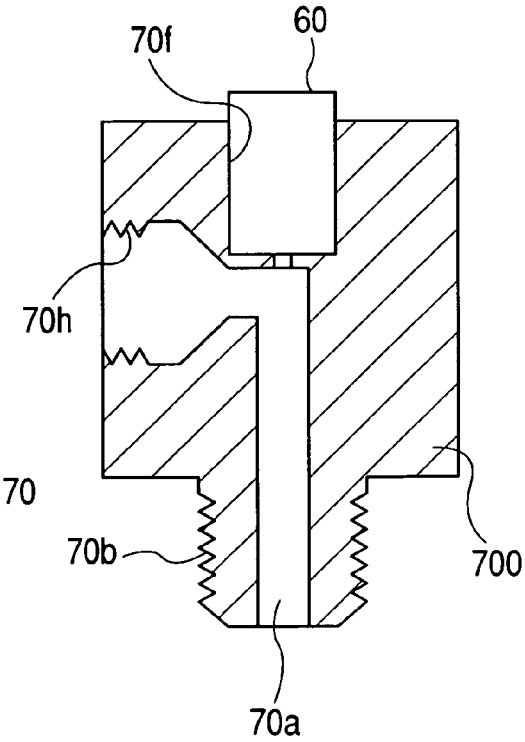

Referring to the drawings, wherein like reference numbers refer to like parts in several views, particularly to FIG. 1, there is shown a fuel pressure sensor/sensor mount assembly according to the first embodiment of the invention. Fuel injectors INJ are installed one in each cylinder of an internal combustion engine such as an automotive diesel engine and mechanically connected to a common rail CL. FIG. 2 is a longitudinal sectional view which shows an internal structure of each of the injectors INJ. FIG. 3 is a schematically perspective view which shows a connector unit 70, as will be described in detail later, which are quipped with sensor mounts. FIG. 4(*a*) is a cross section, as represented by a dashed line in FIG. 3, of the connector unit 70, as viewed from an arrow I.

Each of the injectors INJ, as illustrated in FIG. 2, works to spray the fuel, as supplied from the common rail CL, into a corresponding one E1 of combustion chambers of the internal combustion engine. The injectors INJ are installed in a cylinder head E2 of the engine.

The engine, as referred to herein, is an automotive in-line four-cylinder four-stroke reciprocating diesel engine in which high-pressure light fuel is to be injected directly into the combustion chamber E1 at an atmospheric pressure of 1000 or more. The common rail CL serves as a fuel accumulator which is supplied with the high-pressure fuel, as fed from a fuel tank through a fuel pump (not shown).

The injector INJ includes a nozzle 1, a piezo actuator 2, and a back pressure control mechanism 3. The piezo actuator 2 is equipped with a piezoelectric device which expands or contracts when charged or discharged to open or close the nozzle 1. The back pressure control mechanism 3 is driven by the piezo actuator 2 to control the back pressure acting on the nozzle 1. Instead of the piezo actuator 2, a solenoid coil may be employed to actuate the back pressure control mechanism 3. Alternatively, in place of the back pressure control mechanism 3, the injector INJ may be designed as a direct-acting fuel injector in which an actuator opens or closes the nozzle 1 directly.

The nozzle 1 is made up of a nozzle body 12 in which spray holes 11 are formed, a needle 13, and a spring 14. The needle 13 is to be moved into or out of abutment with an inner seat formed in the nozzle body 12 to close or open the spray holes 11. The spring 14 urges the needle 13 in a valve-closing direction in which the spray holes 11 are closed.

The piezo actuator 2 is made of a stack of piezoelectric elements (which is usually called a piezo stack). The piezoelectric elements are capacitive loads which expand or contact through the piezoelectric effect. When charged, the piezo stack expands, while when discharged, the piezo stack contacts. Specifically, the piezo stack serves as an actuator to move the needle 13. The piezo actuator 2 is supplied with electric power from conductors (not shown) joined to an electric connector CN, as illustrated in FIG. 1.

The back pressure control mechanism 3 includes a valve body 31 which has formed therein an inner fluid path in which a head portion of a piston 32 and a ball valve 33 are disposed. The piston 32 is moved by the contraction or expansion of the piezo actuator 2 to lift up or down the ball valve 33. The valve body 31 is illustrated as being made of a single member, but actually formed by a plurality of blocks.

The injector INJ also includes a cylindrical injector body 4 which has formed therein a cylindrical inner chamber 41 extending substantially in an axial or longitudinal direction of the injector INJ (i.e., a vertical direction, as viewed in FIG. 2). The inner chamber 41 has a lower end, as viewed in the drawing, defined by an inner annular shoulder (or flange) of the injector body 4. The piezo actuator 2 and the back pressure control mechanism 3 are disposed in the inner chamber 41. A hollow cylindrical retainer 5 is threadably fitted to the injector body 4 to secure the nozzle 1 to the end of the injector body 4.

The injector body 4, the valve body 31, and the nozzle body 12 have formed therein high-pressure fuel paths 4*a*, 31*a*, and 12*a* which define a fuel flow path into which the fuel is delivered at a high pressure from the common rail CL at all times. The injector body 4 and the valve body 31 have formed therein a low-pressure fuel path 4*b* leading to the fuel tank (not shown). The nozzle body 12, the injector body 4, and the valve body 31 are each made of metal and installed in a mount hole E3 formed in a cylinder head E2 of the engine. The injector body 4 has an outer shoulder 42 with which an end of a clamp K is to engage for securing the fuel injector INJ in the mount hole E3 tightly Specifically, installation of the fuel injector INJ in the mount hole E3 is achieved by fastening the other end of the clamp K to the cylinder head E2 through a bolt to press the outer shoulder 42 into the mount hole E3.

Between the outer periphery of a top portion of the needle 13 close to the spray holes 11 and the inner periphery of the nozzle body 12, a high-pressure chamber 15 is formed which establishes a fluid communication between the high-pressure fuel path 4*a* and the spray holes 11 when the needle 13 is lifted up in a valve-opening direction. The high-pressure chamber 15 is supplied with the high-pressure fuel through the high-pressure fuel path 31*a* at all times. A back-pressure chamber 16 is formed by one of ends of the needle 13 which is opposite the spray holes 11. The spring 14 is disposed within the back-pressure chamber 16 to urge the needle 13 in the valve-closing direction.

The valve body 31 has formed therein a high-pressure seat 35 exposed to a fluid path extending between the high-pressure fuel path 31*a* and the back-pressure chamber 16. The valve body 31 has also formed therein a low-pressure seat 36 exposed to a path extending between the low-pressure fuel path 4*b* and the back-pressure chamber 16 in the nozzle 1. The low-pressure seat 36 faces the high-pressure seat 35 to define a valve chamber within which the ball valve 33 is disposed.

The injector body 4 has a high-pressure port (i.e., a fuel inlet) 43 to which a high-pressure pipe 50 is to be joined through the connector unit 70, as illustrated in FIGS. 1 and 3, and a low-pressure port (i.e., a fuel outlet) 44 to which a low-pressure pipe (i.e., a drain pipe) is to be connected. The high-pressure port 43 is, as illustrated in FIG. 2, located farther away from the spray hole 11 than the clamp K, but may be located closer to the spray holes 11 than the clamp K. The high-pressure port 43 extends from the axial end of the injector body 4, but may be formed on a side wall of the injector body 4.

In operation, the fuel, as stored in the common rail CL at a high pressure, is delivered from outlets of the common rail CL, one for each cylinder of the engine, and supplied to the high-pressure ports 43 of the fuel injectors INJ through the high-pressure pipes 50 and the connector unit 70. The fuel then passes through the high-pressure fuel paths 4*a* and 31*a* and enters the high-pressure chamber 15 and the back pressure chamber 16. When the piezoelectric actuator 2 is in a contracted state, the valve 33 is, as illustrated in FIG. 2, urged into abutment with the low-pressure seat 36 to establish the fluid communication between the back-pressure chamber 16 and the high-pressure fuel path 31*a*, so that the high-pressure fuel is supplied to the back-pressure chamber 16. The pressure of the fuel in the back-pressure chamber 16 and the elastic pressure, as produced by the spring 14, act on the needle 13 to urge it in the valve-closing direction to close the spray holes 11.

Alternatively, when the piezoelectric actuator 2 is charged so that it is placed in an expanded state, the valve 33 is pushed into abutment with the high-pressure seat 35 to establish the fluid communication between the back-pressure chamber 16 and the low-pressure fuel path 4*b*, so that the pressure in the back-pressure chamber 16 drops, thereby causing the needle 13 to be urged by the pressure of fuel in the high-pressure chamber 15 in the valve-opening direction to open the spray holes 11 to spray the fuel into the combustion chamber E1 of the engine.

The spraying of the fuel from the spray holes 11 of each of the fuel injectors INJ will result in a variation in pressure of the fuel in the injector INJ. Fuel pressure sensors 60 working to monitor such a fuel variation are installed, one for each injector INJ, in the connector unit 70. The time when the fuel has started to be sprayed actually from the injector INJ may be found by sampling the time when the pressure of fuel has started to drop from the waveform of an output from the fuel pressure sensor 60. The time when the fuel has stopped from being sprayed actually from the injector INJ may be found by sampling the time when the pressure of fuel has started to rise from the waveform of the output from the fuel pressure sensor 60. The quantity of fuel having been sprayed from the injector INJ may be found by sampling the amount by which the fuel has dropped from the waveform of the output of the fuel pressure sensor 60. In other words, each of the fuel pressure sensors 60 works to detect a change in injection rate arising from the spraying of fuel from a corresponding one of the fuel injectors INJ.

Next, the fuel pressure sensors 60 and the connector unit 70 will be described below with reference to FIG. 3.

The connector unit 70 is made of metal and to be disposed between the high-pressure ports 43 of the fuel injectors INJ and the high-pressure pipes 50. The connector unit 70 has formed therein communication paths 70*a* each of which communicates with one of the high-pressure pipes 50. Specifically, the communication path 70*a* establishes a fluid communication between a fuel inlet 43*a* of the high-pressure port 43 of each of the injectors INJ and an outlet of a corresponding one of the high-pressure pipes 50.

The connector unit 70 has as many joint-screws 70*b* as the cylinders of the engine which serve as downstream joints to be connected to the high-pressure ports 43 of the injectors INJ. Additionally, the connector unit 70 also has as many joint-screw holes 70*h* as the cylinders of the engine which serve as upstream joints to be connected to the high-pressure pipes 50.

The connector unit 70 also has as many mount holes 70*f* as the cylinders of the engine which are formed in the side wall thereof. Each of the fuel pressure sensor 60 is mounted in one of the mount holes 70*f*. The connector unit 70 further has branch paths 70*g*, as illustrated in FIG. 4(*a*), each of which diverges from one of the communication paths 70*a* and extends in a lateral direction of the connector unit 70. The fuel pressure sensors 60 are fit in the connector unit 70 through metal tough seals, respectively.

Each of the fuel pressure sensors 60 is equipped with a stem 61 working as a pressure deformable member which is sensitive to the pressure of fuel in the branch path 70*g* to deform elastically and a strain gauge 62 working as a sensing device to convert the elastic deformation or distortion of the stem 61 into an electric signal. The stem 61 is made of a metallic material which has the mechanical strength great enough to withstand the high-pressure of the fuel in the branch path 70*g* and a coefficient of thermal expansion low enough to keep adverse effects on the operation of the strain gauge 62 within an allowable range. For example, the stem 61 is made of material lower in coefficient of thermal expansion than the connector unit 70 to minimize the distortion of the stem 61 itself arising from thermal expansion or contraction thereof. This permits a total production cost of the connector unit 70 and the fuel pressure sensors 60 to be decreased as compared with when the whole of the connector unit 70 is made of material having a lower coefficient of thermal expansion.

The stem 61 includes a hollow cylindrical body 61*b*, as illustrated in FIG. 4(*a*), and a circular plate-made diaphragm 61*c*. The cylindrical body 61*b* has formed in an end thereof a fuel inlet 61*a* into which the fuel is introduced from the branch path 70*g*. The diaphragm 61*c* closes the other end of the cylindrical body 61*b*. The pressure of the fuel entering the cylindrical body 61*b* at the fuel inlet 61*a* is exerted on the diaphragm 61*c* and an inner wall of the cylindrical body 61*b*, so that the stem 61 is deformed elastically as a whole.

The cylindrical body 61*b* and the diaphragm 61*c* are axial-symmetrical with respect to a longitudinal center line (i.e., an axis) of the mount hole 70*f* which extends laterally, as viewed in FIG. 4(*a*), so that the diaphragm 61*c* will deform axisymmetrically when subjected to the pressure of the fuel. This causes the diaphragm 61*c* to be deformed proportional to the degree of pressure of the fuel accurately. The strain gauge 62 senses the degree of deformation of the diaphragm 61*c* and produced an electrical signal as a function of the pressure of the fuel exerted on the diaphragm 61*c*.

The strain gauge 62 is affixed to a mount surface of the diaphragm 61*e* (i.e., one of major surfaces of the diaphragm 61*c* which is far away from the fuel inlet 61*a*) through an insulating film (not shown). When the pressure of the fuel enters the cylindrical body 61*b*, so that the stem 61 elastically expands, the diaphragm 61*c* will deform. This causes the strain gauge 62 to produce an electrical output as a function of the amount of deformation of the diaphragm 61*c*.

A sequence of steps of installing the fuel injectors INJ, the connector unit 70, and the high-pressure pipes 50 in and on the cylinder head E2 will be described below.

First, in an engine compartment of the vehicle, each of the fuel injectors INJ is inserted into the mount hole E3 of the cylinder head E2. The clamp K is fastened to the cylinder head E2 using a bolt to mount the injector INJ in the cylinder head E2.

Outside the engine compartment, the fuel pressure sensors 60 is installed in the connector unit 70 to complete the fuel pressure sensor/sensor mount assembly. The connector unit 70 is joined to the high-pressure pipes 50 together to make a sensor/connector assembly made up of the fuel pressure sensors 60, the high-pressure pipes 50, and the connector unit 70.

Next, in the engine compartment, the sensor/connector assembly is joined to the fuel injectors INJ. Specifically, the joint screws 70*b* of the connector unit 70 are fastened to the high-pressure ports 43 of the fuel injectors INJ. The high-pressure pipes 50 connected to the joint-screw holes 70*h* of the connector unit 70 are coupled to the common rail CL. This completes the installation of the injectors INJ, the connector unit 70, and the high-pressure pipes 50 in or on the cylinder head E2 of the engine.

The sensor/connector assembly may alternatively made up of the fuel pressure sensors 60 and the connector unit 70. In this case, after the sensor/connector assembly is coupled to the fuel injectors INJ, the high-pressure pipes 50 are connected to the connector unit 70.

The above described first embodiment offers the following beneficial effects.

1) The communication paths 70*a* each of which is to establish a fluid communication between one of the fuel injectors INJ and one of the high-pressure pipes 50 are formed in the connector unit 70. The connector unit 70 is designed to couple the fuel injectors INJ and the high-pressure pipes 50. The fuel pressure sensors 60 are installed in the connector unit 70 so as to be exposed to the communication paths 70*a*. Specifically, the fuel pressure sensors 60 and the connector unit 70 are prepared as the fuel pressure sensor/sensor mount assembly before being joined to the fuel injectors INJ, thus facilitating the ease of installation of the fuel pressure sensors 60 and joining of the fuel injectors INJ to the common rail CL within the engine compartment.
2) The fuel pressure sensors 60 are installed in the connector unit 70. The connector unit 70 is placed to joint between the high-pressure ports 43 of the fuel injectors INJ and the high-pressure pipes 50. Specifically, the connector unit 70 occupies the part of space between the fuel injectors INJ and the common rail CL, thus eliminating the need for increasing the overall size of the fuel injectors INJ caused by the installation of the fuel pressure sensors 60 in the fuel injectors INJ and also minimizing the space required to install the fuel pressure sensors 60 within the engine compartment.
3) The connector unit 70 is designed to be separate from the injector body 4 and coupled with the fuel injectors INJ detachably, thus permitting the fuel injectors INJ to be installed in the cylinder head E2 independently from the connector unit 70. This improves the workability to install the fuel injectors INJ to the engine.
4) The connector unit 70 is designed to be separate from the injector body 4 and coupled with the fuel injectors INJ detachably, thus permitting typical fuel injectors to be employed as the fuel injectors INJ, in other words, eliminating the need for designing the fuel injectors INJ specially.

The second embodiment of the invention will be described below.

FIG. 4(*b*) illustrates a connector unit 700 that is a modification of the connector unit 70, as shown in FIGS. 3 and 4(*a*).

The communication path 70*a* is formed in the connector unit 70 to be of an L-shape. Specifically, the joint-screw hole 70*h* is formed in a side wall of the connector unit 700, while the mount hole 70*f* is formed in the upper surface of the connector unit 700.

If the high-pressure pipes 50 which are bent at right angles are employed with the connector unit 70 of FIG. 4(*a*), it is difficult to decrease the radius of curvature of the bends of the high-pressure pipes 50 sufficiently, thus resulting in the need for increasing the space for installation of the high-pressure pipes 50 within the engine compartment. The use of the connector unit 700 of FIG. 4(*b*), however, enables the bent high-pressure pipes 50 to be disposed within a minimum space of the engine compartment.

The third embodiment of the invention will be described below with reference to FIG. 5.

In the first embodiment, the connector unit 70 has formed therein as many communication paths 70*a* as the cylinders of the engine to install all the fuel pressure sensors 60 in the connector unit 70. The second embodiment has a plurality of discrete connector units 701. The engine, as referred to herein, has four cylinders as an example. The two connector units 701 are used one for two of the cylinders of the engine.

Each of the connector units 701 has formed therein the two communication paths 70*a* and the two fuel pressure sensors 60. Each of the connector units 701 also has a center hole 701*a* through which a bolt BT is to be inserted.

The installation of two of the fuel injectors INJ in the cylinder head E2 of the engine is achieved by inserting the bolt BT into the center hole 701*a* of the connector unit 701 and fastening the bolt BT into the cylinder head E2 of the engine. Specifically, the connector unit 701 functions as a clamp to retain the fuel injectors INJ in the cylinder head E2, thereby eliminating the need for the clamp K, as employed in the first embodiment. The center hole 701*a* serves as a joint together with the bolt BT to join the connector unit 701 and the cylinder head E2, in other words, to retain the fuel injectors INJ in the cylinder head E2. The center hole 701*a* is preferably located intermediate between the injectors INJ.

The structure of the connector units 701, as described above, eliminates the need for the clamp K, thus resulting in a decease in parts required to install the fuel injectors INJ in the engine cylinder 2 as compared with the first embodiment. The installation of two of the fuel injectors INJ to the engine is achieved only by securing one of the connector units 701 to the cylinder head E2, thus permitting the number of steps required to retain the fuel injectors INJ and the connector units 701 within the engine compartment to be decreased as compared with the first embodiment.

The two connector units 701 are used to secure the four fuel injectors INJ to the engine, which ensures the pressure great enough to hold the fuel injectors INJ within the mount holes E3 of the cylinder head E2 firmly as compared with a single connector unit is used as a clamp to retain all the fuel injectors INJ in the engine. Particularly, when three or more of the fuel injectors INJ are installed in the cylinder head E2 using a single connector unit, it is difficult to ensure the pressure great enough to press the fuel injectors INJ against the cylinder head E2. However, in this embodiment, one of the connector unit 701 is used to secure two of the fuel injectors INJ, thus ensuring the pressure required to retain the fuel injectors INJ in the cylinder head E2 firmly.

The fourth embodiment of the invention will be described below with reference to FIG. 6.

The connector unit 702 has formed therein a common wire distribution path 702*a* through which wires or conductors of the fuel pressure sensors 60 extend. The connector unit 702 has installed therein a common connector CN1 to which the conductors of the fuel pressure sensors 60 are joined. A connector CN2 is to be joined to the common connector CN1 to connect the fuel pressure sensors 60 to an engine ECU through a wire harness W.

The structure of the connector unit 702 facilitates the ease of joining of the wire harness W to the fuel pressure sensors 60 through the common connector C10 and results in decreased steps of connecting the fuel pressure sensors 60 and the engine ECU through the connector CN2.

The fifth embodiment of the invention will be described below with reference to FIG. 7.

The connector unit 703 has formed therein a coolant path 703*a* through which cooling water or coolant flows. The coolant path 703*a* extends over locations where the fuel pressure sensors 60 are joined to the connector unit 703. Specifically, the coolant path 703*a* extends along the length of the connector unit 703 and passes therethrough. The coolant path 703*a* has formed at one of ends thereof a coolant inlet 703*b* into which coolant of the engine enters and at the other end a coolant outlet 703*c* from which the coolant emerges.

Usually, the relation between the pressure of fuel, as represented by an output of the fuel pressure sensor 60, and an actual pressure of fuel flowing into the fuel injector INJ (i.e., an output characteristic of the fuel pressure sensor 60) depends upon the temperature of the fuel pressure sensor 60. In other words, the output of the fuel pressure sensor 60 usually changes with a change in temperature of thereof regardless of an actual pressure of the fuel flowing into the fuel injector INJ, which rises a concern about a deterioration of accuracy in measuring the pressure of the fuel using the output of the fuel pressure sensor 60. In order to address such a concern, the connector unit 703 is designed to have the coolant path 703*a* to keep the temperature of the fuel pressure sensors 60 constant.

Usually a change in temperature of coolant of the engine is smaller than that of the cylinder head E2. The mere recirculation of coolant of the engine through the coolant path 703*a*, therefore, minimizes a change in pressure of the fuel pressure sensors 60 to ensure the measurement accuracy of the fuel pressure sensors 60.

Figure 8:
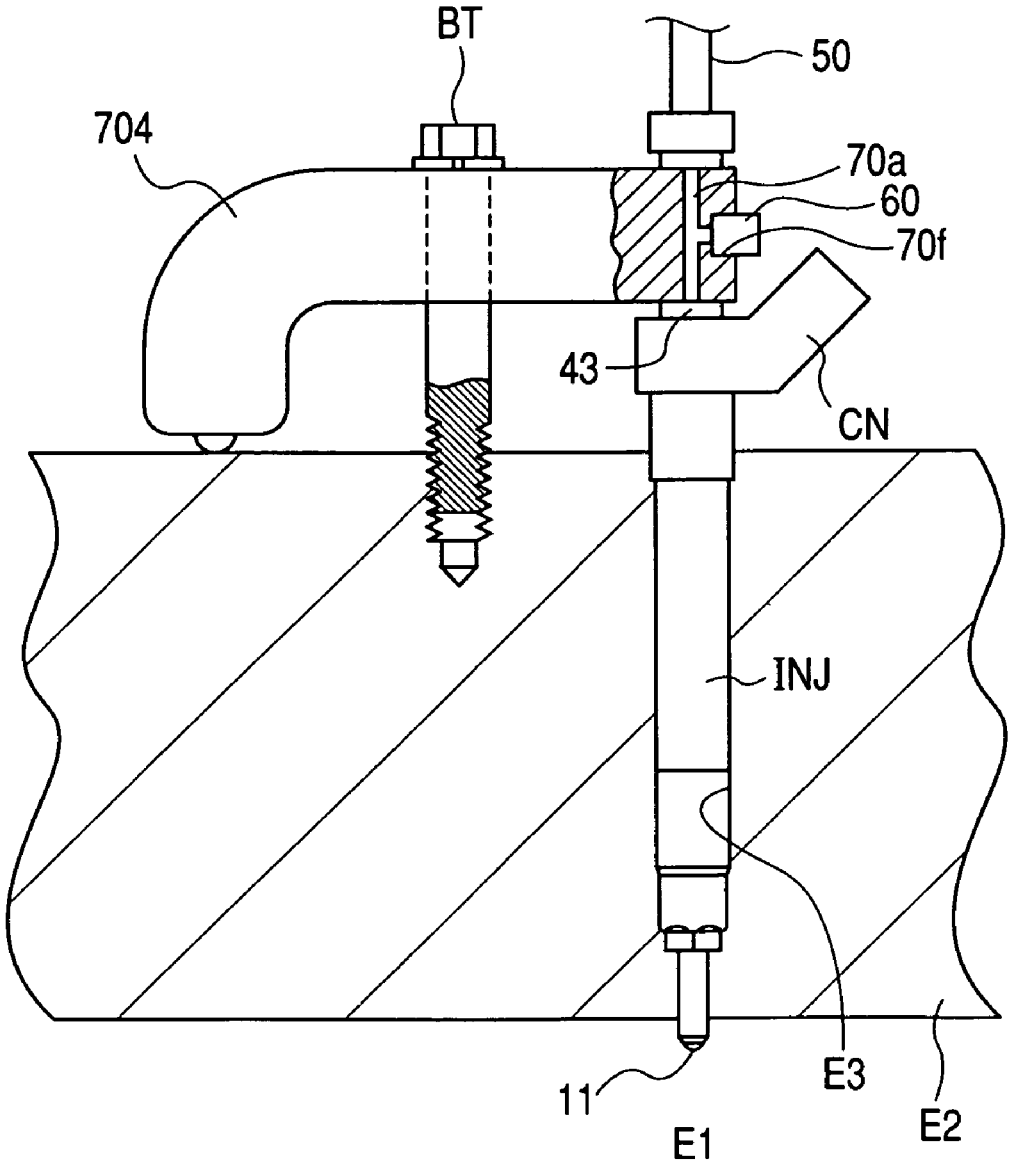
FIG. 8 is a schematic view which shows a clamp which mounts a fuel injector to a cylinder head of an engine according to the sixth embodiment of the invention.

The sixth embodiment of the invention will be described below with reference to FIG. 8.

Clamps 704 are used instead of the clamp K, as illustrated in FIG. 2. Each of the clamps 704 has the communication path 70*a* which is to communicate with one of the high-pressure pipes 50. Each of the clamp 704 has formed therein the mount hole 70*f* in which one of the fuel pressure sensors 60 is installed. Specifically, each of the clamps 704 serves as a connector establishing a fluid communication between the high-pressure port 43 of a corresponding one of the fuel injectors INJ and a corresponding one of the high-pressure pipes 50.

As apparent from the above, each of the clamps 704 has formed therein one of the communication paths 70*a* which is to be connected to a corresponding one of the high-pressure pipes 50. In other words, the clamps 704 are provided one for each of the cylinders of the engine.

Use of the clamps 704 eliminates the need for the connector unit(s) 70, 700, 701, or 704, as described in the above embodiments, thus resulting in a decease in parts required to install the fuel injectors INJ in the engine cylinder E2 and also permitting the number of steps required to retain the fuel injectors INJ within the engine compartment to be decreased.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiment which can be embodied without departing from the principle of the invention as set forth in the appended claims.

Figure 5:
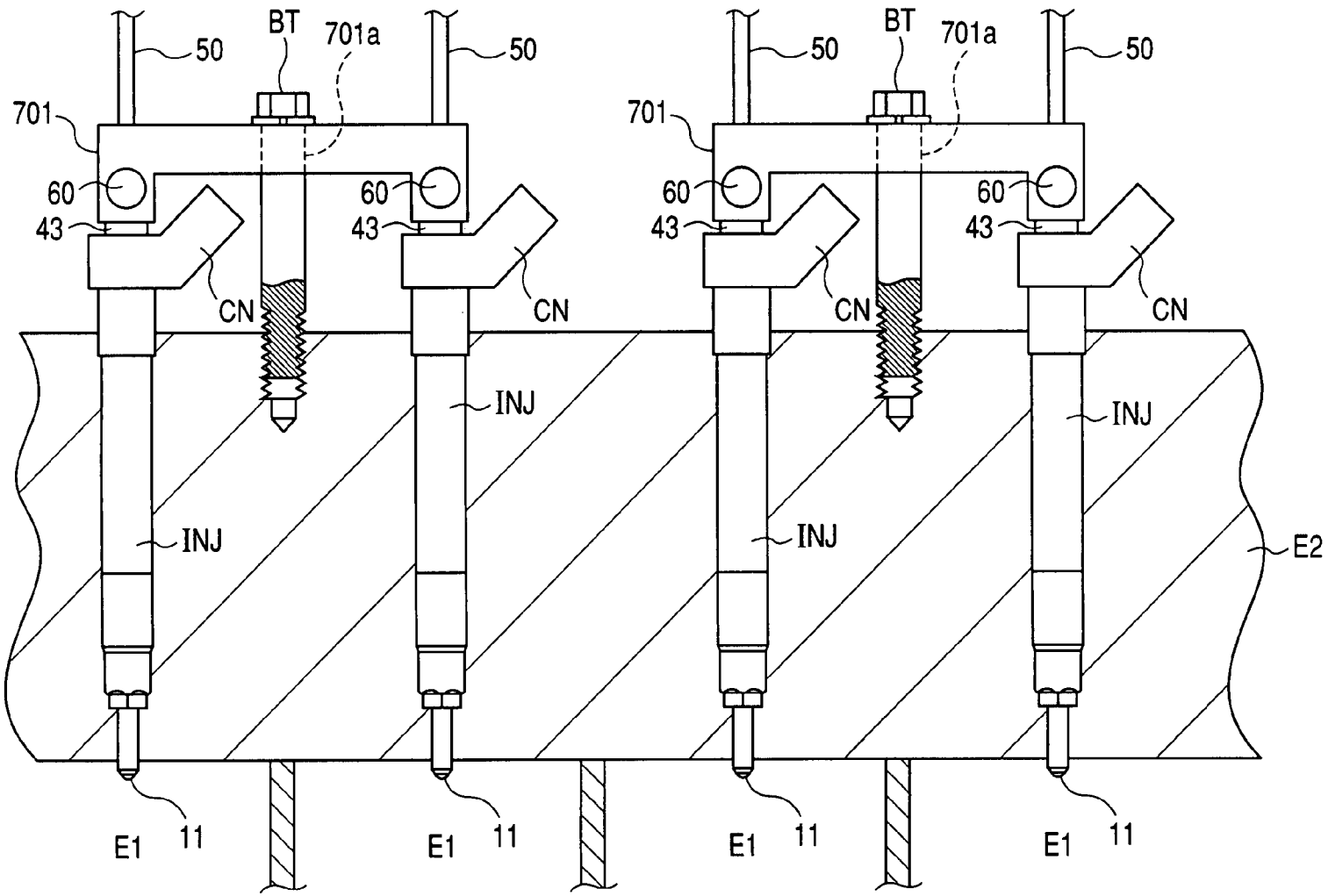
FIG. 5 is a plan view which shows connector units according to the third embodiment of the invention in which fuel pressure sensors are mounted and which establishes mechanical joints between the fuel injectors and a common rail.
Figure 6:
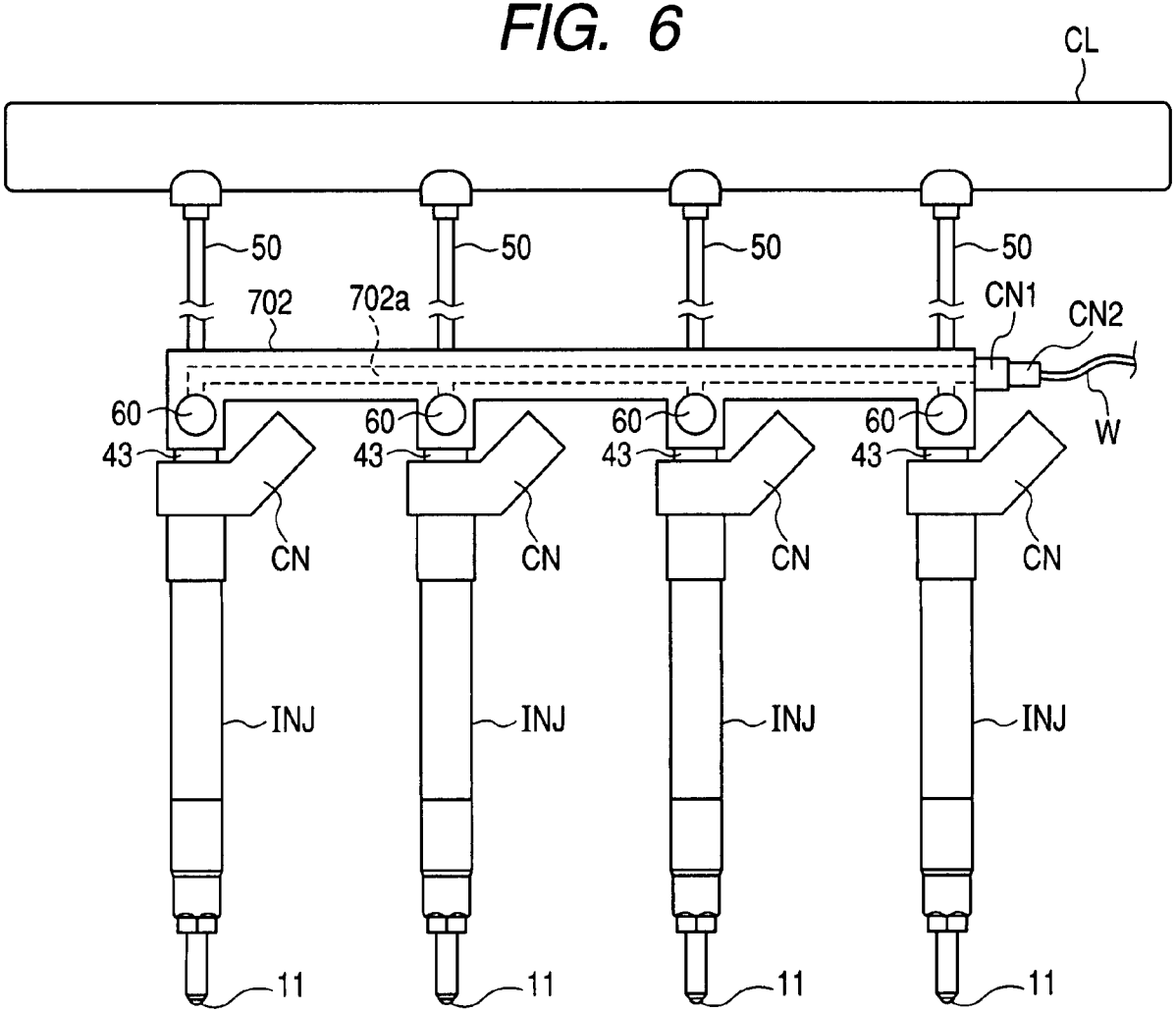
FIG. 6 is a schematic view which shows fuel injectors joined to a common rail through a connector unit according to the fourth embodiment of the invention.
Figure 7:
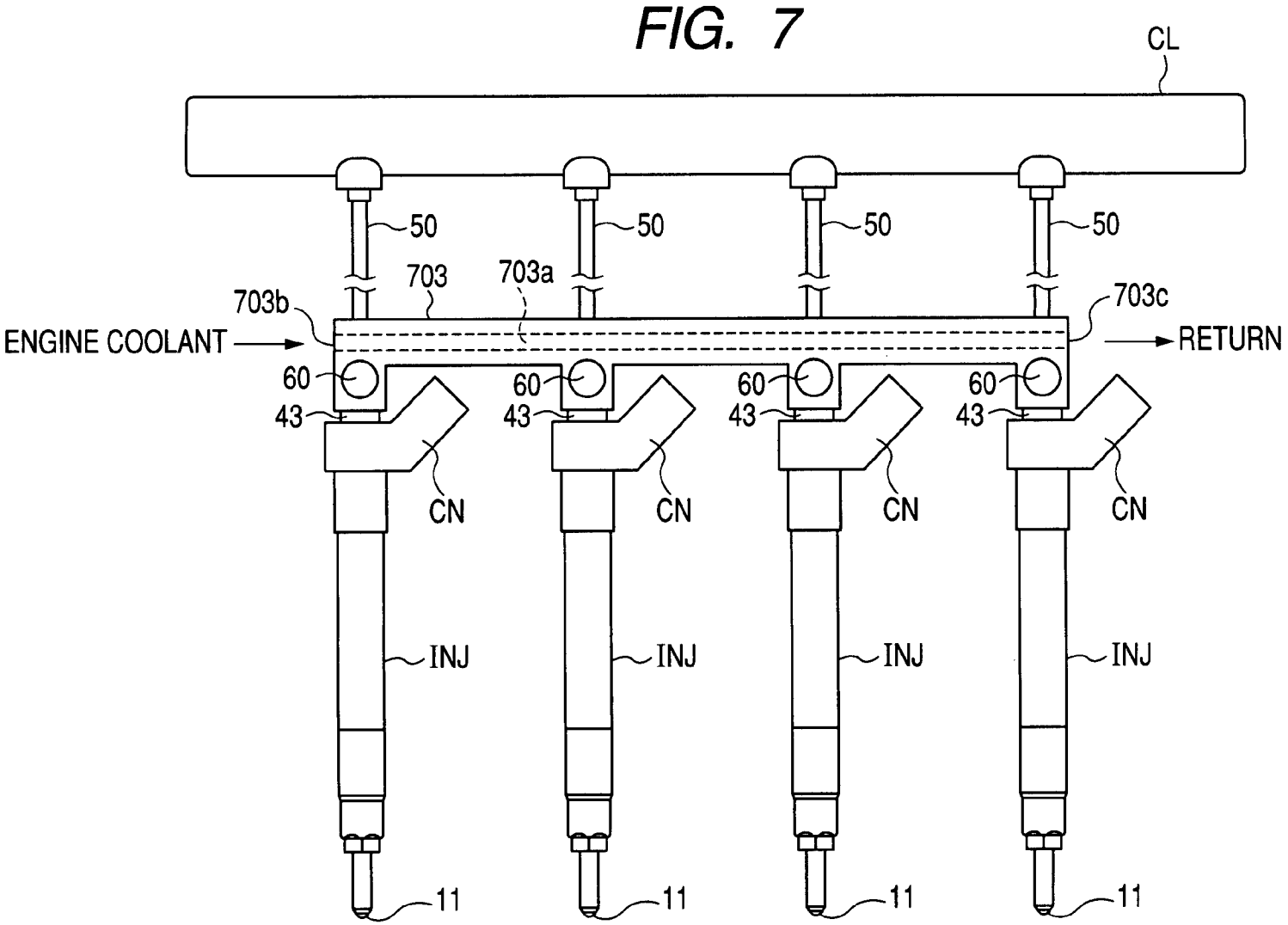
FIG. 7 is a schematic view which shows fuel injectors joined to a common rail through a connector unit according to the fifth embodiment of the invention.

For example, the structure of each of the connector unit 701, as illustrated in FIG. 5, may be designed to have the common wire distribution path 702*a* of FIG. 6 and/or the coolant path 703*a* of FIG. 7.

The connector unit(s) 70, 700, 701, 702 or 703 may be disposed between the high-pressure pipes 50 and the common rail CL, not between the high-pressure pipes 50 and the fuel injectors INJ.

Each of the fuel pressure sensors 60 may be equipped with a sensing element such as a piezoelectric device instead of the strain gauge 62.

The invention may alternatively be used with fuel injectors to be installed in gasoline engines such as direct injection gasoline engines designed to inject the fuel directly into the combustion chambers E1 of the engine.

What is claimed is:

1. A fuel pressure sensor/sensor mount assembly for use in a fuel injection system equipped with fuel injectors which inject fuel, as supplied from an accumulator through fuel pipes, into a multi-cylinder internal combustion engine mounted in an engine compartment of a vehicle, comprising:

a connector unit having formed therein a plurality of communication paths each of which is to establish a connection between one of the fuel injectors and the accumulator through one of the fuel pipes, said connector unit also having formed therein sensor mounts exposed to the communication paths, respectively; and fuel pressure sensors mounted one in each of the sensor mounts of said connector unit, each of said fuel pressure sensors being sensitive to a pressure of the fuel in a corresponding one of the communication paths to produce a signal indicative thereof.

2. A fuel pressure sensor/sensor mount assembly as set forth in claim 1, wherein said connector unit is disposed between the fuel injectors and the fuel pipes.

3. A fuel pressure sensor/sensor mount assembly as forth in claim 1, wherein the communication paths are formed in said connector unit, one for each of all of cylinders of the internal combustion engine.

4. A fuel pressure sensor/sensor mount assembly as set forth in claim 1, wherein said connector unit has a joint serving to establish a mechanical joint of said connector unit to a cylinder head of the internal combustion engine, so that said connector unit functions as a clamp to clamp the fuel injectors to the cylinder head.

5. A fuel pressure sensor/sensor mount assembly as set forth in claim 1, further comprising a second connector unit identical in structure as said connector unit, and wherein each of said connector unit and said second connector unit has a joint serving to establish a mechanical joint to a cylinder head of the internal combustion engine, so that each of said connector unit and said connector unit functions as a clamp to clamp the fuel injectors to the cylinder head.

6. A fuel pressure sensor/sensor mount assembly as set forth in claim 1, wherein said connector unit has formed therein a common wire distribution path through which conductive wires of said fuel pressure sensors extend.

7. A fuel pressure sensor/sensor mount assembly as set forth in claim 1, wherein said connector unit has a common connector to which conductive wires of said fuel pressure sensors are joined.

8. A fuel pressure sensor/sensor mount assembly as set forth in claim 1, wherein said connector unit is equipped with a cooling mechanism working to cool said fuel pressure sensors.

9. A fuel pressure sensor/sensor mount assembly as set forth in claim 8, wherein the cooling mechanism includes a coolant path formed in said connector unit through which coolant flows to cool said fuel pressure sensors.

10. A fuel pressure sensor/sensor mount assembly for use in a fuel injection system equipped with fuel injectors which inject fuel, as supplied from an accumulator through fuel pipes, into a multi-cylinder internal combustion engine mounted in an engine compartment of a vehicle, comprising:

clamps working to clamp the fuel injector to a cylinder head of the internal combustion engine, said clamp having formed therein a plurality of communication paths each of which is to establish a connection between one of the fuel injectors and the accumulator through one of the fuel pipes, said clamps also having formed therein sensor mounts exposed to the communication paths, respectively; and fuel pressure sensors mounted one in each of the sensor mounts of said clamps, each of said fuel pressure sensors being sensitive to a pressure of the fuel in a corresponding one of the communication paths to produce a signal indicative thereof.

* * * * *